US011123839B2

(12) United States Patent
Loveless et al.

(10) Patent No.: US 11,123,839 B2
(45) Date of Patent: Sep. 21, 2021

(54) GRINDER DUST SHROUD WITH INPUT SHAFT GASKET AND ADJUSTABLE MOUNTING MECHANISM

(71) Applicant: Dustless Depot, LLC, Price, UT (US)

(72) Inventors: Spencer Loveless, Price, UT (US); Kendall Hansen, Price, UT (US)

(73) Assignee: DUSTLESS DEPOT LLC, Price, UT (US)

( * ) Notice: Subject to any disclaimer, the term of this patent is extended or adjusted under 35 U.S.C. 154(b) by 569 days.

(21) Appl. No.: 16/168,475

(22) Filed: Oct. 23, 2018

(65) Prior Publication Data

US 2020/0122294 A1 Apr. 23, 2020

(51) Int. Cl.

| | |
|---|---|
| ***B24B 55/10*** | (2006.01) |
| ***B24B 55/05*** | (2006.01) |
| ***B24B 23/02*** | (2006.01) |
| ***B24B 55/04*** | (2006.01) |

(52) U.S. Cl.

CPC ..... *B24B 55/102* (2013.01); *B24B 23/028* (2013.01); *B24B 55/04* (2013.01); *B24B 55/05* (2013.01); *B24B 55/052* (2013.01); *B24B 55/10* (2013.01)

(58) Field of Classification Search

CPC ..... B24B 23/02; B24B 23/028; B24B 55/04; B24B 55/05; B24B 55/052; B24B 55/10; B24B 55/102

USPC ..... 451/359, 451, 456

See application file for complete search history.

(56) References Cited

U.S. PATENT DOCUMENTS

| | | | |
|---|---|---|---|
| 437,004 | A | 9/1890 | Shipley |
| 907,734 | A | 12/1908 | Butterfield |
| 1,123,562 | A | 1/1915 | Lund |
| 1,197,967 | A | 9/1916 | Swenson |
| 1,302,263 | A | 4/1919 | Woodworth |
| RE15,262 | E | 1/1922 | Gurgel |
| 1,432,660 | A | 10/1922 | Borque |
| 1,643,882 | A | 9/1927 | Faiver |
| 1,779,031 | A | 10/1930 | Casey |
| 1,850,504 | A | 3/1932 | Janes |
| 2,032,382 | A | 3/1936 | Torrison |
| 2,041,689 | A | 5/1936 | Baumeister |

(Continued)

FOREIGN PATENT DOCUMENTS

| | | |
|---|---|---|
| DE | 3811197 | 10/1989 |
| EP | 556713 | 8/1993 |

(Continued)

OTHER PUBLICATIONS

Bosch TG502 Tuck pointing grinder guard, accessed 2018, from Amazon.ca.

*Primary Examiner* — Eileen P Morgan

(74) *Attorney, Agent, or Firm* — Pate Peterson PLLC; Brett Peterson

(57) ABSTRACT

An angle grinder dust collection shroud includes mounting brackets which are attached to a shroud body via slots which allow the mounting brackets to move to different circumferential locations around the output shaft of the angle grinder as well and inwardly towards and outwardly away from the output shaft of the angle grinder. The mounting brackets are adjustable in their position around the angle grinder output shaft to allow them to engage the angle grinder while avoiding any mounting features for the angle grinder's stock blade guard.

20 Claims, 6 Drawing Sheets

(56) References Cited

U.S. PATENT DOCUMENTS 2,212,361 A 8/1940 Arthur
2,279,186 A 4/1942 Terry et al.
2,291,269 A 7/1942 Wiggleworth
2,294,272 A 8/1942 Boice
2,312,443 A 3/1943 Reiter
2,384,688 A 9/1945 Morris
2,440,684 A 5/1948 Huelster
2,440,685 A 5/1948 Huelster
2,503,854 A 4/1950 Trainor
2,520,725 A 8/1950 Judd
2,676,624 A 4/1954 Gecman
2,803,098 A 8/1957 Robert et al.
2,817,134 A 12/1957 Fenton
2,819,570 A * 1/1958 Tocci-Guilbert ..... B24B 55/05 451/451
2,819,571 A 1/1958 Morgan
2,994,995 A 8/1961 Griffith
3,166,877 A 1/1965 Reames
3,256,648 A 6/1966 Subonovich
3,468,076 A 9/1969 Jones
3,511,322 A 5/1970 Holman
3,667,170 A 6/1972 MacKay
3,673,744 A 7/1972 Oimoen
3,826,045 A 7/1974 Champayne
3,835,543 A 9/1974 Polydoris et al.
3,848,686 A 11/1974 Jysky et al.
3,862,521 A 1/1975 Isaksson
3,882,598 A 5/1975 Earle et al.
3,882,644 A 5/1975 Cusumano
3,945,281 A 3/1976 Kreitz
3,987,589 A 10/1976 Marton
4,011,792 A 3/1977 Davis
4,016,649 A 4/1977 Kloster
4,033,035 A 7/1977 Trimmer
4,063,478 A 12/1977 Stuy
4,090,297 A 5/1978 Wanner
4,135,334 A 1/1979 Rudiger
4,160,319 A 7/1979 Caruso
4,201,256 A 5/1980 Truhan
4,241,505 A 12/1980 Bodycomb, Jr. et al.
4,253,362 A 3/1981 Olson
4,296,572 A 10/1981 Quintana
4,300,426 A 11/1981 Weaver
4,326,864 A 4/1982 Sittier
4,367,665 A 1/1983 Terpstra et al.
4,381,628 A 5/1983 Dicke
4,400,995 A 8/1983 Palm
4,456,303 A 6/1984 Due
4,515,504 A 5/1985 Moore
4,566,511 A 1/1986 Robinson
4,574,532 A 3/1986 Haberle et al.
4,576,072 A 3/1986 Terpstra et al.
4,622,782 A 11/1986 Roestenberg
4,641,401 A 2/1987 Hasegawa
4,646,480 A 3/1987 Williams
4,697,389 A 10/1987 Romine
4,761,877 A 8/1988 Rupp
4,765,099 A 8/1988 Tanner
4,782,632 A 11/1988 Matechuk
4,868,949 A 9/1989 Loveless et al.
4,891,915 A 1/1990 Yasuda
4,905,420 A 3/1990 Flachenecker et al.
4,921,308 A 5/1990 Yelton et al.
4,921,375 A 5/1990 Famulari
4,930,264 A 6/1990 Huang
4,932,163 A 6/1990 Chilton et al.
4,932,164 A 6/1990 Sullivan et al.
5,033,552 A 7/1991 Hu
5,034,041 A 7/1991 Austin
5,069,695 A 12/1991 Austin
5,074,044 A 12/1991 Duncan et al.
5,084,972 A 2/1992 Waugh
5,105,585 A 4/1992 Hampl et al.
5,125,190 A 6/1992 Buser et al.
5,131,192 A 7/1992 Cheng
5,163,252 A 11/1992 Garner et al.
5,167,215 A 12/1992 Harding, Jr.
5,170,588 A 12/1992 Schaal
5,176,408 A 1/1993 Pedersen
5,201,785 A 4/1993 Nagano
5,237,781 A 8/1993 Demetrius
5,259,087 A 11/1993 Loveless et al.
5,305,729 A 4/1994 Chiuminatta et al.
5,319,889 A 6/1994 Rudolf et al.
5,327,649 A 7/1994 Skinner
5,339,571 A 8/1994 Timmons et al.
5,381,780 A 1/1995 Yelton et al.
5,411,433 A 5/1995 Keller
5,435,066 A 7/1995 Bare
5,440,809 A 8/1995 Padilla
5,445,056 A 8/1995 Folci
5,527,207 A 6/1996 Azar et al.
5,545,082 A 8/1996 Courson et al.
5,558,571 A 9/1996 Toyoshima et al.
5,564,408 A 10/1996 Bassols
5,566,457 A 10/1996 Batschari et al.
5,575,035 A 11/1996 Reis et al.
D376,526 S 12/1996 Hepburn
5,582,225 A 12/1996 Schank
5,588,213 A 12/1996 Swanberg
5,609,516 A 3/1997 Courson et al.
5,637,034 A 6/1997 Everts et al.
5,653,561 A 8/1997 May
5,662,440 A 9/1997 Kikuchi
5,675,895 A 10/1997 Mori et al.
5,680,704 A 10/1997 Okubo
5,688,082 A 11/1997 Richardson
5,704,956 A 1/1998 Loveless et al.
5,713,785 A 2/1998 Nishio
D392,531 S 3/1998 Richardson
5,774,992 A 7/1998 Lindenmuth
5,791,979 A 8/1998 Duncan et al.
5,815,933 A 10/1998 Staniszewski
5,816,733 A 10/1998 Ishikawa et al.
5,819,619 A 10/1998 Miller et al.
5,833,524 A 11/1998 Satoh et al.
5,931,072 A 8/1999 Shibata
5,941,765 A 8/1999 Taylor
5,954,863 A 9/1999 Loveless et al.
6,019,433 A 2/2000 Allen
6,027,399 A 2/2000 Stewart
6,053,674 A 4/2000 Thompson
6,108,912 A 8/2000 Radigan
6,112,736 A 9/2000 Bearden
6,138,317 A 10/2000 Holmes et al.
6,167,626 B1 1/2001 Doumani et al.
6,183,527 B1 2/2001 O'Banion et al.
6,219,922 B1 4/2001 Campbell et al.
6,230,411 B1 5/2001 Wall
6,273,081 B1 8/2001 Gorgol et al.
6,318,352 B1 11/2001 Gnazzo et al.
6,347,985 B1 2/2002 Loveless
6,349,712 B1 2/2002 Halstead
D456,234 S 4/2002 Keller
6,375,557 B1 4/2002 Spangenberg et al.
D456,685 S 5/2002 Keller
D458,825 S 6/2002 Keller et al.
6,412,179 B1 7/2002 Ende
6,470,778 B1 10/2002 Kaye, Jr. et al.
6,471,574 B1 10/2002 Rupprecht et al.
6,557,261 B1 5/2003 Buser et al.
6,568,088 B1 5/2003 Ende
6,648,742 B1 11/2003 Segiel
6,651,343 B2 11/2003 Laren et al.
6,678,960 B2 1/2004 Williams
6,679,145 B1 1/2004 Lee
6,699,114 B1 3/2004 Booeshaghi et al.
6,726,554 B1 4/2004 Chen et al.
6,748,660 B2 6/2004 Buser et al.
6,786,556 B2 9/2004 Due
6,796,208 B1 9/2004 Jorgensen
6,811,476 B2 11/2004 Ohlendorf
6,823,907 B2 11/2004 Cheng
D499,946 S 12/2004 Stirm

(56) References Cited

U.S. PATENT DOCUMENTS 6,827,640 B2 12/2004 Bures et al.
6,860,799 B2 3/2005 Loveless
6,878,050 B2 4/2005 Wendt et al.
6,886,441 B2 5/2005 Hamilton
6,887,146 B2 5/2005 Staas
6,896,604 B1 5/2005 Taylor
6,896,605 B2 5/2005 Ohlendorf
6,902,594 B2 6/2005 Cho
6,935,939 B1 8/2005 Buser et al.
6,948,412 B2 9/2005 Brazell et al.
6,960,124 B2 11/2005 Lee
D513,161 S 12/2005 Chilton
6,988,939 B2 1/2006 Hoffmann et al.
6,997,653 B2 2/2006 Styles
7,000,605 B2 2/2006 Due
7,013,884 B2 3/2006 Guth
7,014,547 B2 3/2006 Kleider
7,044,039 B2 5/2006 Powell
7,044,843 B1 5/2006 Lin
7,047,647 B1 5/2006 Muller
7,047,650 B2 5/2006 Chen
7,069,831 B2 7/2006 Chang
7,112,005 B2 9/2006 Due
7,159,323 B2 1/2007 Petrenko
7,171,880 B2 2/2007 Powell
D537,691 S 3/2007 Lamprecht et al.
D537,692 S 3/2007 Aglassinger
7,195,429 B2 3/2007 Dods et al.
7,197,826 B2 4/2007 Baxivanelis
7,198,559 B2 4/2007 Waistrum et al.
7,204,178 B2 4/2007 Bergmann
7,216,572 B2 5/2007 Keenan
7,222,560 B2 5/2007 Parks et al.
7,223,161 B2 5/2007 Kodani et al.
7,249,914 B2 7/2007 Due
D553,933 S 10/2007 Esenwein
7,296,356 B2 11/2007 Ngan
7,300,337 B1 11/2007 Sun et al.
7,300,339 B2 11/2007 Gaul et al.
7,322,429 B2 1/2008 Kim
7,438,629 B2 10/2008 Bosten et al.
7,438,633 B2 10/2008 Jespersen
D593,389 S 6/2009 Clayton
7,578,063 B2 8/2009 Martin
7,625,265 B2 12/2009 Woods et al.
7,628,682 B2 * 12/2009 Andrasic ..... B24B 55/052 451/359
7,635,293 B2 12/2009 Sun et al.
7,661,194 B1 2/2010 Ende
7,661,195 B1 2/2010 Wood
D614,678 S 4/2010 Jorgensen et al.
7,740,086 B2 6/2010 Bleicher et al.
7,805,805 B2 10/2010 Loveless
7,887,624 B2 2/2011 Ekstrom et al.
7,892,075 B2 * 2/2011 Esenwein ..... B24B 55/052 451/451
7,958,641 B1 6/2011 Ende
7,985,042 B1 7/2011 Paxton
8,011,398 B2 9/2011 Loveless
8,133,094 B2 3/2012 Loveless
8,137,165 B2 * 3/2012 Loveless ..... B24B 55/102 451/456
8,177,606 B2 5/2012 Loveless
8,181,559 B1 5/2012 Ende
8,209,872 B1 7/2012 Ende
8,381,711 B2 2/2013 Loveless
D677,139 S 3/2013 Yamamoto
D677,545 S 3/2013 Sell
D677,547 S 3/2013 Rosenau
D677,548 S 3/2013 Rosenau
D678,028 S 3/2013 Rosenau
D687,195 S 7/2013 Sell
8,523,637 B2 9/2013 Loveless
8,561,512 B2 10/2013 Loveless
8,662,964 B2 3/2014 Hiller
8,702,478 B2 * 4/2014 Loveless ..... B24B 55/102 451/453
8,740,674 B2 6/2014 Esenwein
D717,844 S 11/2014 Cappuccio
D719,806 S 12/2014 Wiedemann
8,978,781 B2 3/2015 Burdick et al.
9,027,542 B2 5/2015 Ronzello
9,038,275 B2 5/2015 Jensen et al.
D736,582 S 8/2015 Dietsche
9,101,993 B2 8/2015 Yokota et al.
D741,557 S 10/2015 Young
D742,081 S 10/2015 Young
D742,710 S 11/2015 Wiedemann
D743,230 S 11/2015 Wiedemann
D774,865 S 12/2016 Chen
9,555,554 B2 1/2017 Thorson et al.
D793,456 S 8/2017 Lindsay
D800,804 S 10/2017 Cappuccio
9,776,296 B2 10/2017 Brewster
9,937,638 B2 4/2018 Numata
D816,453 S 5/2018 Hansen et al.
10,035,240 B2 * 7/2018 Buser ..... B24B 55/102
10,173,345 B2 1/2019 Numata et al.
10,800,003 B2 * 10/2020 Moller ..... B24B 55/06
D908,149 S * 1/2021 Hansen ..... D15/138
2001/0023168 A1 9/2001 Wuensch
2003/0032381 A1 2/2003 Dutterer
2003/0104767 A1 6/2003 Chilton
2003/0127904 A1 7/2003 Due
2003/0220060 A1 11/2003 Bures
2004/0206220 A1 10/2004 Keenan
2005/0088866 A1 4/2005 Levine
2005/0155233 A1 7/2005 Chen
2005/0287938 A1 12/2005 Kodani
2006/0005681 A1 1/2006 Lambert et al.
2006/0019585 A1 1/2006 Zayat
2006/0086350 A1 4/2006 Due
2006/0147266 A1 7/2006 Due
2006/0266184 A1 11/2006 Hetcher et al.
2007/0017197 A1 1/2007 Olde Weghuis
2007/0079589 A1 4/2007 Ekstrom et al.
2007/0155296 A1 7/2007 Hofmann et al.
2007/0178815 A1 * 8/2007 Buser ..... B24B 55/102 451/451
2007/0193759 A1 8/2007 Sweig et al.
2007/0226948 A1 10/2007 Due
2007/0228805 A1 10/2007 Due
2007/0251104 A1 11/2007 Heinrichs
2008/0053282 A1 3/2008 Chen
2008/0060631 A1 3/2008 Dofher
2008/0099053 A1 5/2008 Loveless
2008/0104936 A1 5/2008 Kellermann
2008/0109986 A1 5/2008 Loveless
2008/0110527 A1 5/2008 Kuo
2008/0146125 A1 6/2008 Loveless
2008/0163492 A1 7/2008 Johansson
2008/0200103 A1 8/2008 Esenwein
2008/0244910 A1 10/2008 Patel
2008/0271323 A1 11/2008 Perlmutter
2009/0181604 A1 7/2009 Loveless
2009/0181605 A1 * 7/2009 Loveless ..... B24B 55/102 451/456
2009/0181606 A1 7/2009 Loveless
2009/0183377 A1 7/2009 Loveless
2009/0183800 A1 7/2009 Loveless
2009/0186559 A1 7/2009 Loveless
2009/0241283 A1 10/2009 Loveless
2009/0298403 A1 12/2009 Yamashiro
2009/0311953 A1 12/2009 Maute et al.
2010/0005619 A1 1/2010 Loveless
2010/0058911 A1 3/2010 Goddard
2010/0170538 A1 7/2010 Baker et al.
2010/0269353 A1 10/2010 Martin
2010/0285729 A1 * 11/2010 Loveless ..... B24B 55/04 451/456
2010/0313867 A1 12/2010 Loveless
2011/0021121 A1 1/2011 Loveless
2011/0185581 A1 8/2011 Xing et al.
2011/0192262 A1 8/2011 Loveless

(56) References Cited

U.S. PATENT DOCUMENTS

| | | | | |
|---|---|---|---|---|
| 2012/0084986 | A1 | 4/2012 | Klawitter | |
| 2012/0121354 | A1 | 5/2012 | Dickey | |
| 2012/0184193 | A1* | 7/2012 | Numata | B24B 23/02 451/453 |
| 2012/0186520 | A1 | 7/2012 | Hill | |
| 2013/0104714 | A1 | 5/2013 | Dammertz et al. | |
| 2013/0198996 | A1 | 8/2013 | King | |
| 2014/0215752 | A1 | 8/2014 | Loveless | |
| 2014/0260848 | A1 | 9/2014 | Gantke et al. | |
| 2014/0329447 | A1 | 11/2014 | Copeland | |
| 2014/0352106 | A1 | 12/2014 | King | |
| 2016/0031054 | A1 | 2/2016 | Chang | |
| 2016/0184963 | A1* | 6/2016 | Melancon | B24B 55/102 55/307 |
| 2016/0368166 | A1 | 12/2016 | Numata et al. | |
| 2017/0144096 | A1 | 5/2017 | Chen | |
| 2017/0225358 | A1 | 8/2017 | Carlsson | |
| 2018/0071845 | A1 | 3/2018 | Hansen et al. | |
| 2018/0169885 | A1 | 6/2018 | Okouchi | |
| 2020/0139508 | A1 | 5/2020 | Ohlendorf | |

FOREIGN PATENT DOCUMENTS

| | | |
|---|---|---|
| EP | 0 579 964 | 1/1994 |
| GB | 2 260 721 | 4/1993 |
| GB | 2 262 159 | 6/1993 |
| JP | 02-122755 | 2/1990 |
| JP | H 06-278103 | 10/1994 |
| JP | 10-000559 | 1/1998 |
| JP | 10-015717 | 1/1998 |
| JP | 2001-96525 | 4/2001 |
| JP | 3128896 | 1/2007 |
| KR | 10-2002-0056086 | 7/2002 |
| WO | WO 99/44786 | 9/1999 |

* cited by examiner

GRINDER DUST SHROUD WITH INPUT SHAFT GASKET AND ADJUSTABLE MOUNTING MECHANISM

THE FIELD OF THE INVENTION

The present invention relates to dust collection. In particular, examples of the present invention relates to a shroud for tools such as angle grinders.

BACKGROUND

Dust collection is important for commercial processes and construction as well as for consumer or hobbyist use of power tools. Without adequate dust collection while working, dust and debris is typically scattered over a wide area. It is desirable to contain the dust and debris which is created while using power tools for several reasons. It is desirable to contain the dust and debris to keep the workplace cleaner and to minimize the time necessary to clean up afterwards. For example, angle grinders are often used to cut or grind cement. Grinding materials such as cement creates fine dust which is spread over a large distance and can be quite difficult to clean up afterwards. It is also desirable to contain the dust and debris to keep the debris from getting into the tool itself, as the fine dust often causes premature failure of the tool bearings, motor, etc. Additionally, dust poses a health risk to the machine operator and others who may breathe it. It is thus desirable to collect the dust to minimize any exposure to the dust.

BRIEF DESCRIPTION OF THE DRAWINGS

Non-limiting and non-exhaustive examples of the present invention are described with reference to the following figures, wherein like reference numerals refer to like parts throughout the various views unless otherwise specified.

Figure 1:
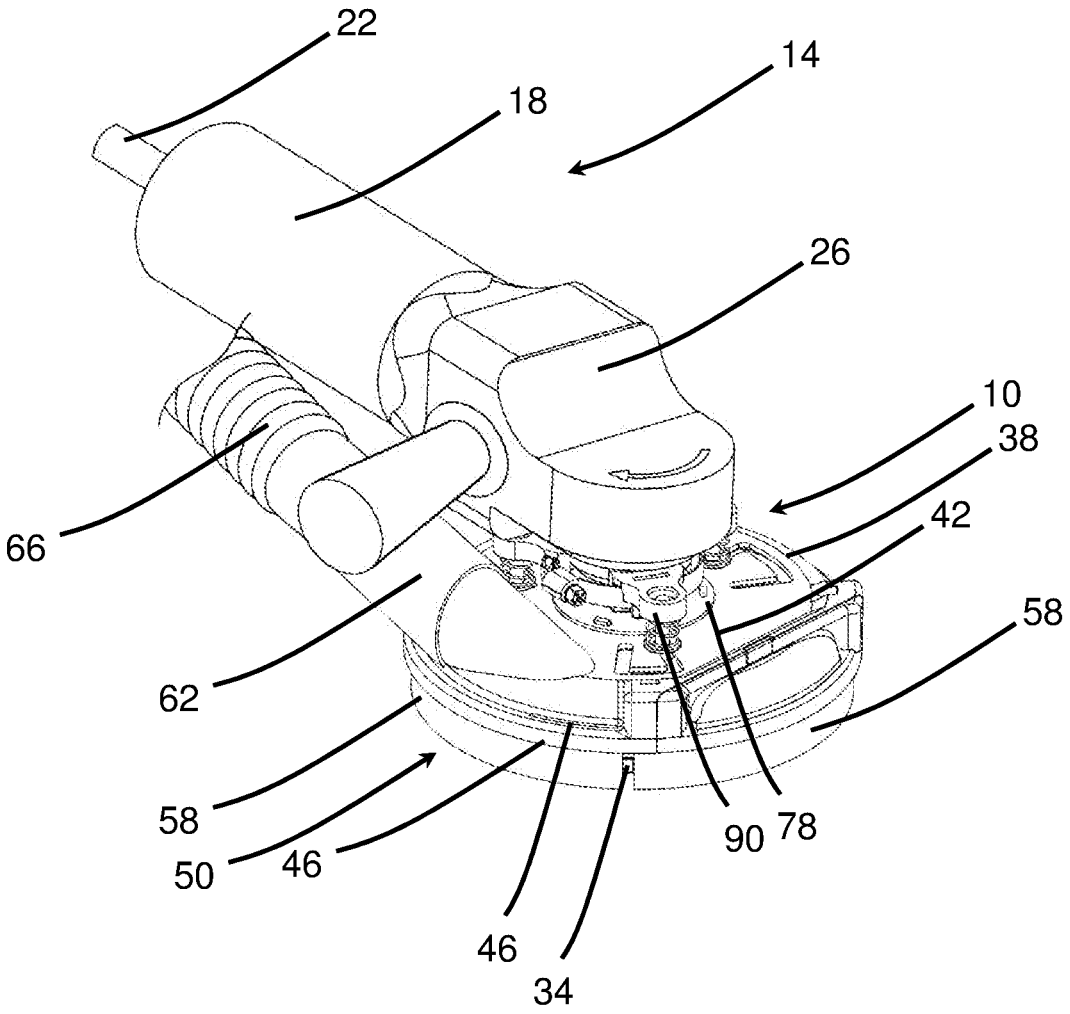
FIG. 1 is a drawing which shows a perspective view of the dust collection shroud installed on an angle grinder.

Corresponding reference characters indicate corresponding components throughout the several views of the drawings. Skilled artisans will appreciate that elements in the figures are illustrated for simplicity and clarity. The drawings have been drawn to scale to allow for easier understanding of the device. Common but well-understood elements that are useful or necessary in a commercially feasible embodiment are often not depicted in order to facilitate a less obstructed view of these various embodiments of the present invention.

It will be appreciated that the drawings are illustrative and not limiting of the scope of the invention which is defined by the appended claims. The examples shown each accomplish various different advantages. It is appreciated that it is not possible to clearly show each element or advantage in a single figure, and as such, multiple figures are presented to separately illustrate the various details of the examples in greater clarity. Similarly, not every example need accomplish all advantages of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art.

Figure 2:
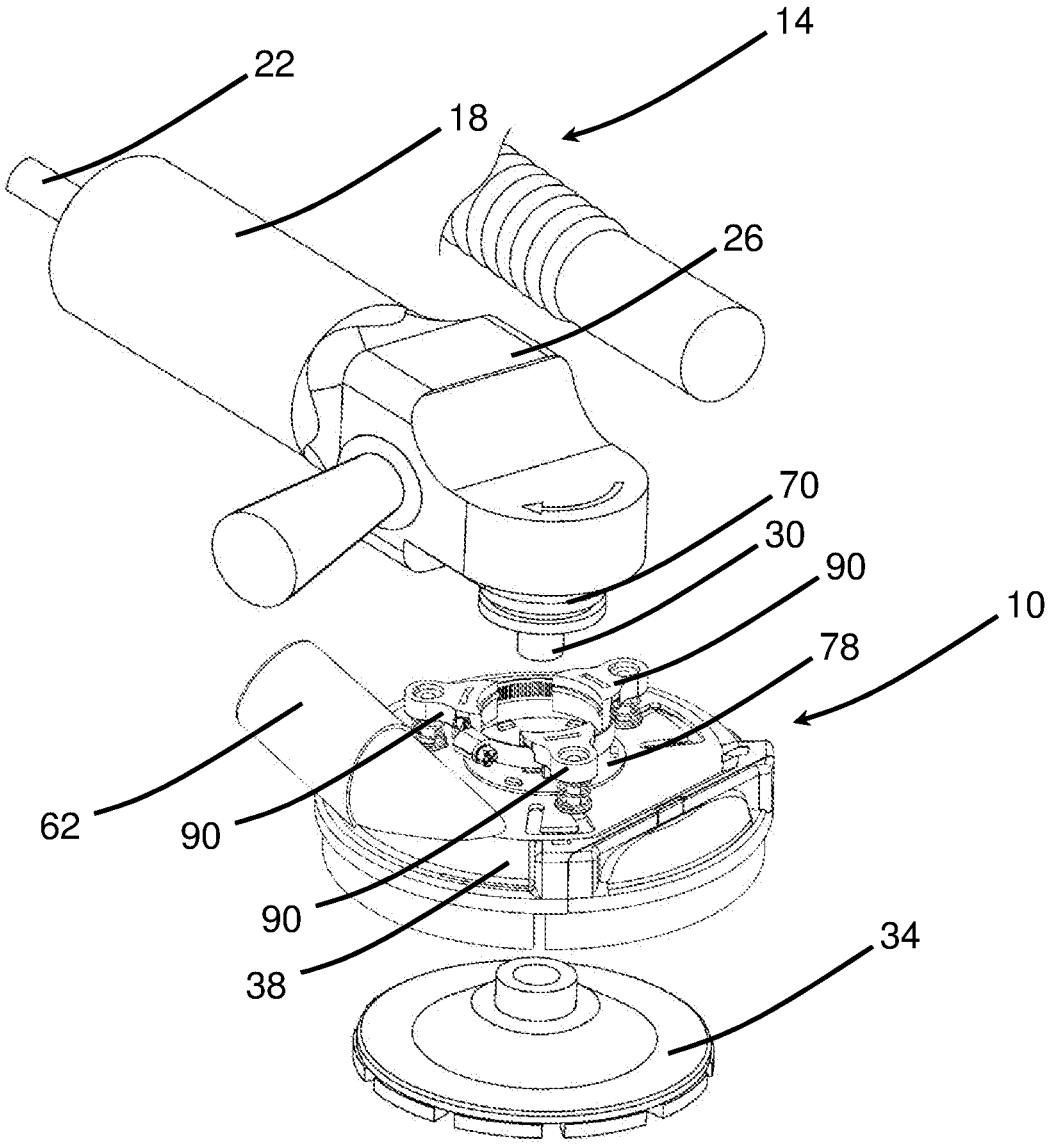
FIG. 2 is a drawing which shows a perspective view of the dust collection shroud and the angle grinder while disassembled.

FIGS. 1 and 2 show perspective drawings of an angle grinder dust collection system. FIG. 1 shows a dust collection shroud 10 installed on an angle grinder 14. FIG. 2 shows a partially disassembled view of the angle grinder 14, grinding wheel 34, and dust collection shroud 10 to better illustrate the shroud attachment structures. The angle grinder 14 includes a grinder body 18 which houses an electric motor and provides a structural support for much of the grinder 14. An electrical power cord 22, switch, etc. may be mounted to the grinder body 18. The angle grinder 14 includes a gearbox 26. The gearbox 26 is used to provide an appropriate output speed for the grinder and is also used to position the output shaft 30 at a 90 degree angle to the motor and body 18. Angle grinders 14 are frequently used with sanding attachments or grinding cup wheels to sand or grind different materials. A diamond cup wheel 34 may be used to grind concrete and masonry. Sanding discs may be used to sand wood, plastics, or fiberglass. These grinding processes create a significant amount of dust, much of which is harmful. Small particulate grinding dust from many different materials is harmful to the lungs and should be contained.

Many angle grinders 14 include a stock blade guard (not shown) which covers a portion of a grinding wheel. The blade guard helps keep debris from hitting the operator. These blade guards, however, do not capture the grinding dust produced by the grinder 14. It is becoming increasingly common for manufacturers to use proprietary quick release attachment systems for blade guards which allow the blade guard to be rotated to different positions around the grinding wheel. These quick release attachment systems make it increasingly difficult to provide a dust collection shroud 10 which fits different angle grinders 14. The shroud 10 provides a mounting system which adapts to different angle grinders 14 and is adjustable to different angle grinders 14 despite the various structures used to mount the original blade guards.

The shroud 10 is used to collect the grinding dust and capture the dust to reduce the environmental and health impact of using the angle grinder 14. The shroud 10 includes a shroud body 38 which is attachable to the angle grinder 14 to enclose the grinding wheel 34. The shroud body 38 includes an upper portion 42 and a sidewall 46 which extends downwardly from the upper portion. The upper portion 42 and sidewall 46 form a dust collection chamber 50 which is generally enclosed and which has an open bottom. As shown, the sidewall 46 is generally round as viewed from above and may be formed with a curved transition between the sidewall and the upper portion 42. The bottom edge of the sidewall 46 may be formed with a channel that receives a skirt 58. The skirt 58 is flexible and contacts the work surface which is being ground by the grinder around the grinding wheel 34 to assist in collecting dust. The skirt 58 may be a flexible plastic or rubber. In this example, the skirt 58 is formed by a plurality of plastic bristles held together in a crimped metal ring. The bristles form a generally continuous skirt wall which is round and encircles the dust collection chamber 50 along the lower edge of the shroud sidewall 46. The skirt 58 is typically preinstalled into the shroud sidewall 46.

The shroud body 38 includes an exhaust port 62. The exhaust port 62 is attached to the upper portion 42 and sidewall 46 so that it is oriented tangentially to the outside of the cup wheel 34 and shroud body 38. The exhaust port 62 opens from the shroud body 38 so that it flows smoothly from the shroud body 38 and continues in the direction of rotation of the cup wheel 34. The exhaust port 62 has an interior bore or passage which is connected to the interior dust collection chamber 50 so that dust can move from the dust collection chamber 50 through the exhaust port 62. In some situations, the exhaust port 62 may be connected to a vacuum to extract dust from the dust shroud body 38. The exhaust port 62 may thus be sized to receive a nominal 1.25 inch or 1.5 inch vacuum hose 66 (or a larger hose for larger shrouds/grinders).

The shroud 10 is attached to the angle grinder 14. Many angle grinders 14 include a shoulder 70 which extends downwardly from the gearbox 26 surrounding the grinder output shaft 30. The shoulder 70 may house bearings to support the output shaft 30. The shoulder 70 of the angle grinder 14 may be generally circular, but often includes registration or attachment features for the original blade guard. These attachment features often interfere with attachment of an aftermarket dust collection shroud 10. The upper portion 42 of the shroud body 38 has a hole 74 therethrough. The hole 74 through the upper portion 42 of the shroud body is typically located in the center of the upper portion of the shroud body. The output shaft 30 of the grinder 14 passes through the hole 74 and into the dust collection chamber 50 so that the cup wheel 34 or other grinding attachment is located in the dust collection chamber 50 when assembled. The hole 74 in the upper portion of the shroud body 38 is larger than the output shaft and is sufficiently large to fit a variety of grinders. A rubber sealing gasket 78 is attached to the top of the shroud body 38 to seal around the output shaft 30; keeping dust contained inside of the dust collection chamber 50 and keeping dust separated from the grinder motor and bearings. The sealing gasket 78 is formed with a number of holes 82 which are spaced apart near its outer edge. The holes 82 are placed over corresponding attachment tabs 86 formed on the top surface of the shroud body 38 around the hole 74.

The shroud 10 includes an attachment structure which is attached to the upper portion 42 of the shroud body 38 and which attached the shroud 10 to the angle grinder 14. In order to accommodate a variety of different angle grinders with a single shroud 10, the shroud includes three movable mounting arms/mounting brackets 90 which are attached to the shroud body 38 so that they may be moved in and out to different distances from the center of the hole 74 and so that they may be moved around the hole 74 to different angular positions around the hole 74. The mounting brackets 90 may be moved to different positions around the opening 74 to accommodate different shoulders 70 of different grinders 14.

Figure 3:
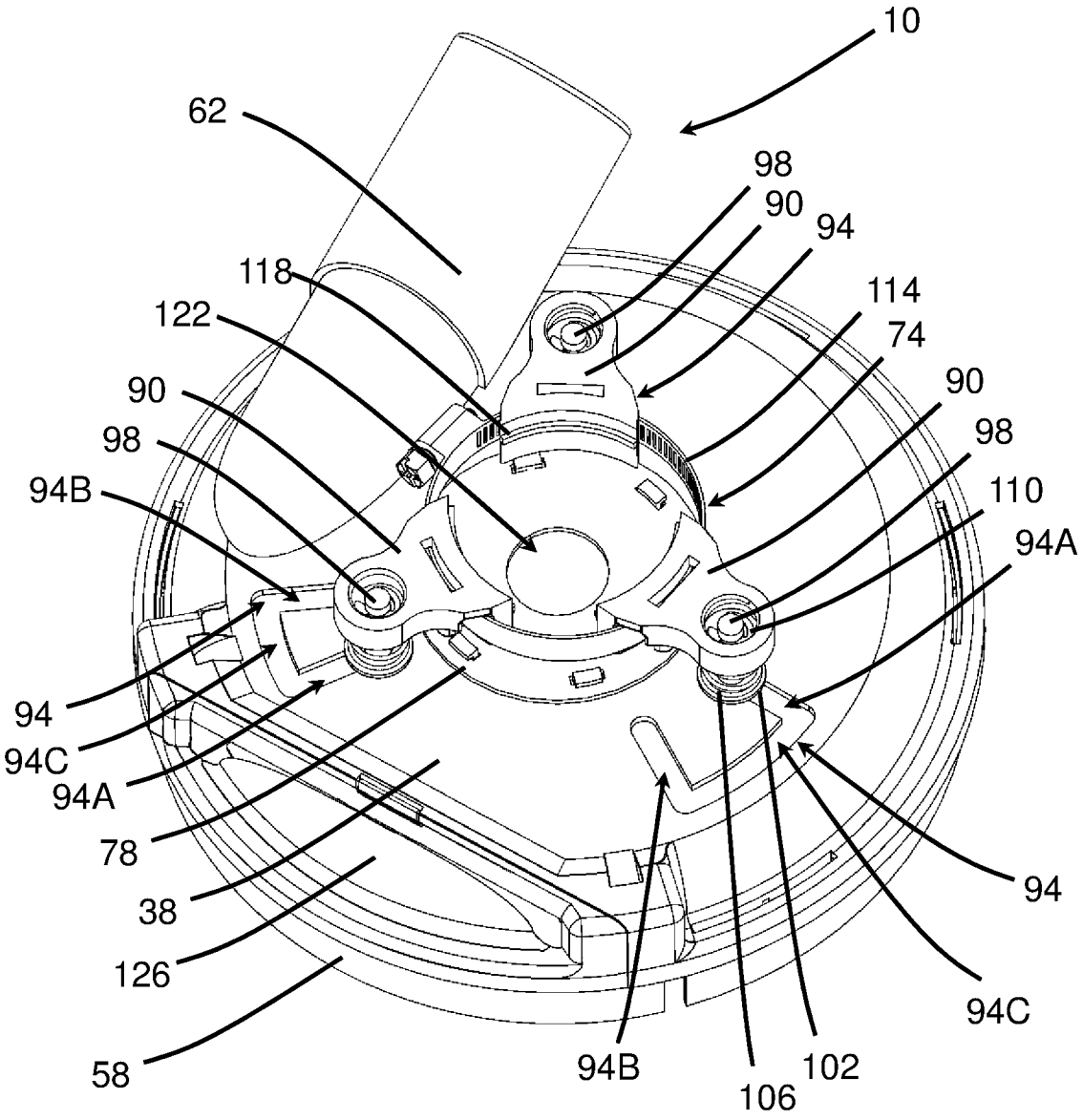
FIG. 3 is a drawing which shows a perspective view of the dust collection shroud.
Figure 4:
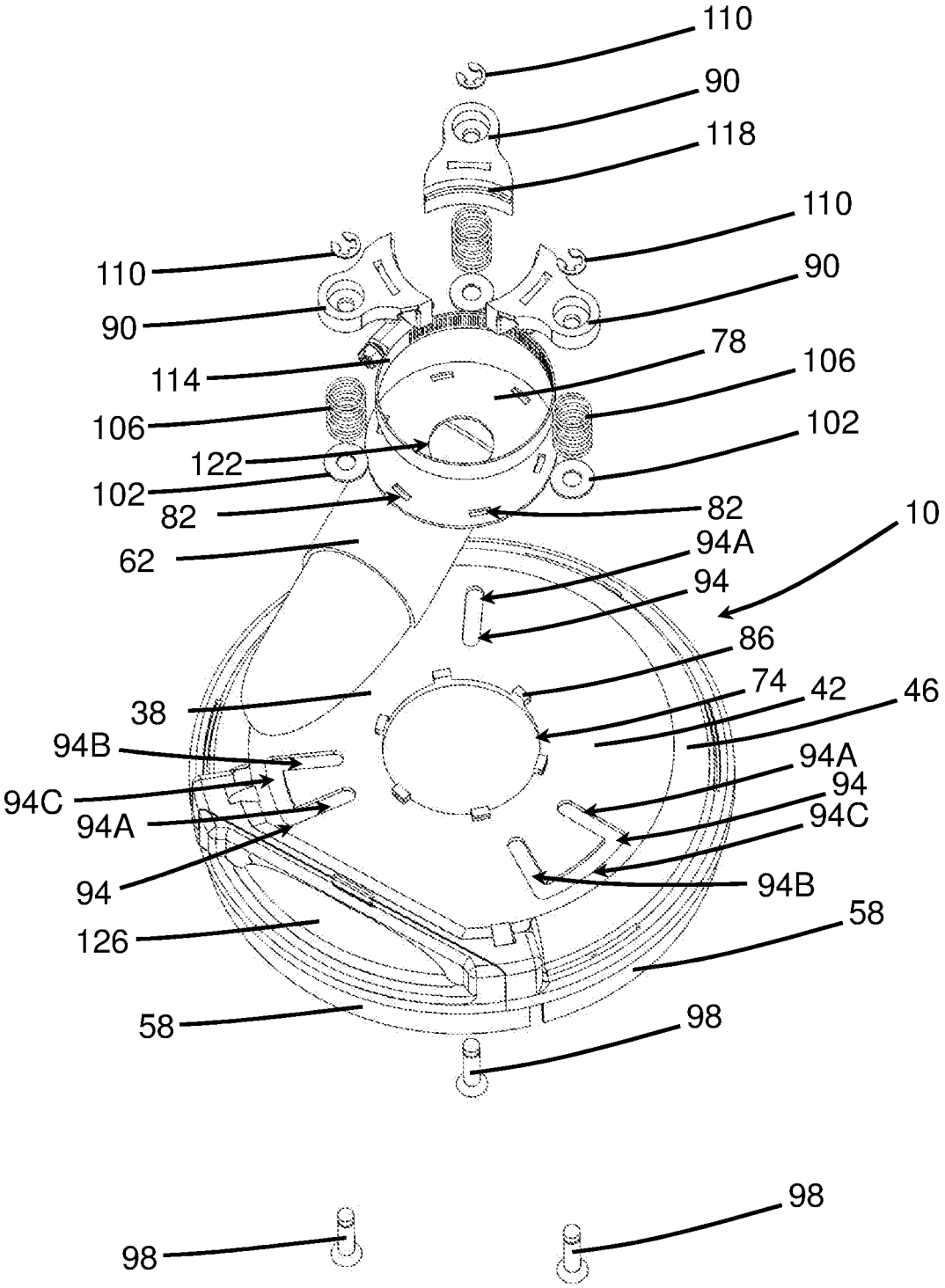
FIG. 4 is a drawing which shows an exploded view of the dust collection shroud.

FIGS. 3 and 4 better illustrate the mounting brackets 90. FIG. 3 shows a larger perspective view of the shroud 10 and FIG. 4 shows an exploded view of the shroud 10. The mounting brackets 90 are attached to the shroud body 38 via slots 94. The slots 94 allow the mounting brackets 90 to slide inwardly and outwardly to adjust the space between the mounting brackets as well as to slide laterally to adjust the position of the mounting brackets 90. The mounting brackets 90 move inwardly and outwardly to adjust the distance between the mounting brackets 90 to accommodate differently sized shoulders 70 on angle grinders 14. The mounting brackets 90 move laterally (to different angular positions around the hole 74) to allow them to be positioned around the hole 74 to accommodate any mounting features on the shoulder 70 for the stock angle grinder blade guard.

The slots 94 include a first slot section 94A which allows the mounting bracket 90 to move inwardly and outwardly relative to the hole 74, a second slot section 94B which allows the mounting bracket 90 to move inwardly and outwardly relative to the hole 74, and a third slot section 94C which connects the first slot section 94A and the second slot section 94B and allows the mounting bracket 90 to move laterally to different positions around the hole 74. In the example shown, the first slot section 94A and the second slot section 94B are oriented in radial alignment with the hole 74 and shaft 30 so that the mounting bracket 90 is movable directly towards or away from the shaft 30 and collar 70. The third slot section 94C is oriented circumferentially around the hole 74 so that the mounting bracket is movable to a different radial position around the output shaft 30 and collar 70. This allows the operator to select between different positions for the mounting bracket 90 while attaching the mounting bracket 90 to the collar 70. If the collar 70 includes an attachment feature for the stock blade guard which interferes with the placement of the mounting bracket 90, the mounting bracket may be moved to a different location in the slot 94 (e.g. from the first slot section 94A to the second slot section 94B). The mounting brackets are located in the first slot sections 94A or second slot sections 94B when the shroud 10 is attached to the grinder 14 to allow the mounting brackets 90 to move into position against the collar 70. As shown, one of the slots 94 may be made with only a first slot section 94A. This provides for one mounting bracket 90 which is in a fixed location around the hole 74. In attaching the shroud 10 to the grinder 14, this mounting bracket may be placed to avoid any mounting features for the stock blade guard and the other mounting brackets 90 may be moved within their slots 94 as discussed to avoid any other mounting features. Each of the slots 94, however, may contain a first slot section 94A, a second slot section 94B, and a third slot section 94C.

The mounting brackets 90 are attached to the shroud body 38 by pins 98 which pass through the slots 94 and through the mounting brackets 90. Each of the pins 98 has a head on the lower end which does not pass through the slots 94 and engages the shroud body 38. The shank of the pin passes through the slot 94, through a washer 102 and a spring 106, through a hole in the mounting bracket 90, and is secured with a fastener such as an e-clip 110 (or not, etc.) on the upper end to secure the pin 98 to the mounting bracket 90.

While the present invention describes the use of springs 106, it will be appreciated that other biasing elements such as an elastomeric tubing will provide the desired amount of flexibility and movement. Compression of the springs 106 allows some vertical movement between the mounting brackets 90 and the shroud body 38, allowing the shroud body 38 to move vertically relative to the mounting brackets 90 and the grinder 14. This allows the operator flexibility in choosing which part of the grinding disk 34 contacts the work surface and in choosing how much pressure to apply to the work surface while grinding. In a resting position, the springs 106 exert a force which pushes the mounting brackets 90 away from the shroud body 38 and biases the shroud body 38 away from the angle grinder 14. This places the bottom of the skirt 58 near (preferably below) the bottom surface of the grinding wheel 34. When an operator brings the grinding wheel 34 into contact with a work surface, the skirt 58 first contacts the work surface and then remains in contact with the work surface while the grinding wheel 34 is then pushed downwardly (along with the grinder 14 and mounting brackets 90) relative to the shroud body 38 and skirt 58 to bring the grinding wheel 34 in contact with the work surface. This arrangement maintains the skirt 58 in contact with the work surface and improves the collection of dust generated while grinding.

A clamp such as a worm drive hose clamp 114 engages shoulders or slots formed on the inward ends of the mounting brackets 90 and is used to securely fasten the mounting brackets 90 to an angle grinder 14 so that the output shaft 30 of the angle grinder 14 passes through the hole 74 and the grinding wheel 34 is located in the dust collection chamber 50. If desired, the interior faces of the mounting brackets 90 which contact the grinder shoulder 70 may be lined with an elastomeric facing, or may include ridges 118 which engage a groove in the shoulder 70 to improve the attachment of the shroud 10 to the angle grinder 14.

These figures better illustrate the sealing gasket 78. As discussed, the sealing gasket 78 is attached to the top of the shroud body 38 to seal around the output shaft 30. The sealing gasket 78 is formed with a number of holes 82 which are spaced apart near its outer edge as well as an output shaft hole 122 at its center. The attachment tabs 86 formed on the top surface of the shroud body 38 extend upwardly from the shroud body 38 and then extend outwardly from the hole 74 in a L or hook shape. The holes 82 are placed over the attachment tabs 86 to secure the sealing gasket 78 to the shroud body 38. While the hole 74 is oversized relative to the grinder output shaft 30, the gasket hole 122 is closely sized to the output shaft 30. If desired, a few sealing gaskets 78 with different sizes of holes 122 may be provided to accommodate common grinders 14.

In use, the shroud 10 is generally pre-assembled, but may require attachment of a sealing gasket 78 and the clamp 114 to the shroud body 38 and mounting brackets 90. The shroud 10 is secured to the angle grinder 14 and a grinding or sanding attachment such as the diamond grinding wheel 34 is installed onto the grinder output shaft 30. The bottom end of the grinder output shaft 30 is typically threaded to allow grinding attachments to be attached thereto. When the grinding attachment 34 is secured in place, the bottom cutting surface of the grinding attachment 34 is typically located below the plane formed by the bottom edge of the sidewall 46 and above the plane formed by the bottom edge of the skirt 58. If the skirt 58 is formed of plastic bristles, for example, it will compress vertically somewhat to maintain contact with an uneven work surface and the springs 106 allow the shroud body 38 to move vertically to allow the bottom cutting surface of the grinding attachment 34 to contact the work surface to grind that surface while keeping the skirt 58 in contact with the work surface to contain dust. A vacuum which is attached to the exhaust port 62 via hose 66 draws air and dust inwardly through slots 94 and through the skirt 58, from around the grinding wheel 34, through the exhaust port 62, and into the vacuum where it is collected. The air flow and dust tend to rotate with the grinding wheel 34 and are carried to the exhaust port 62.

The dust collection shroud 10 may have additional features such as a removable access hatch 126. The access hatch 126 is removable to expose a small amount of the grinding wheel 34 such that the outer cutting edge of the grinding wheel extends beyond the remaining edge of the shroud body 38 after removal of the access hatch 126. This allows an operator to grind against a vertical surface, such as when grinding a floor against a wall.

Figure 5:
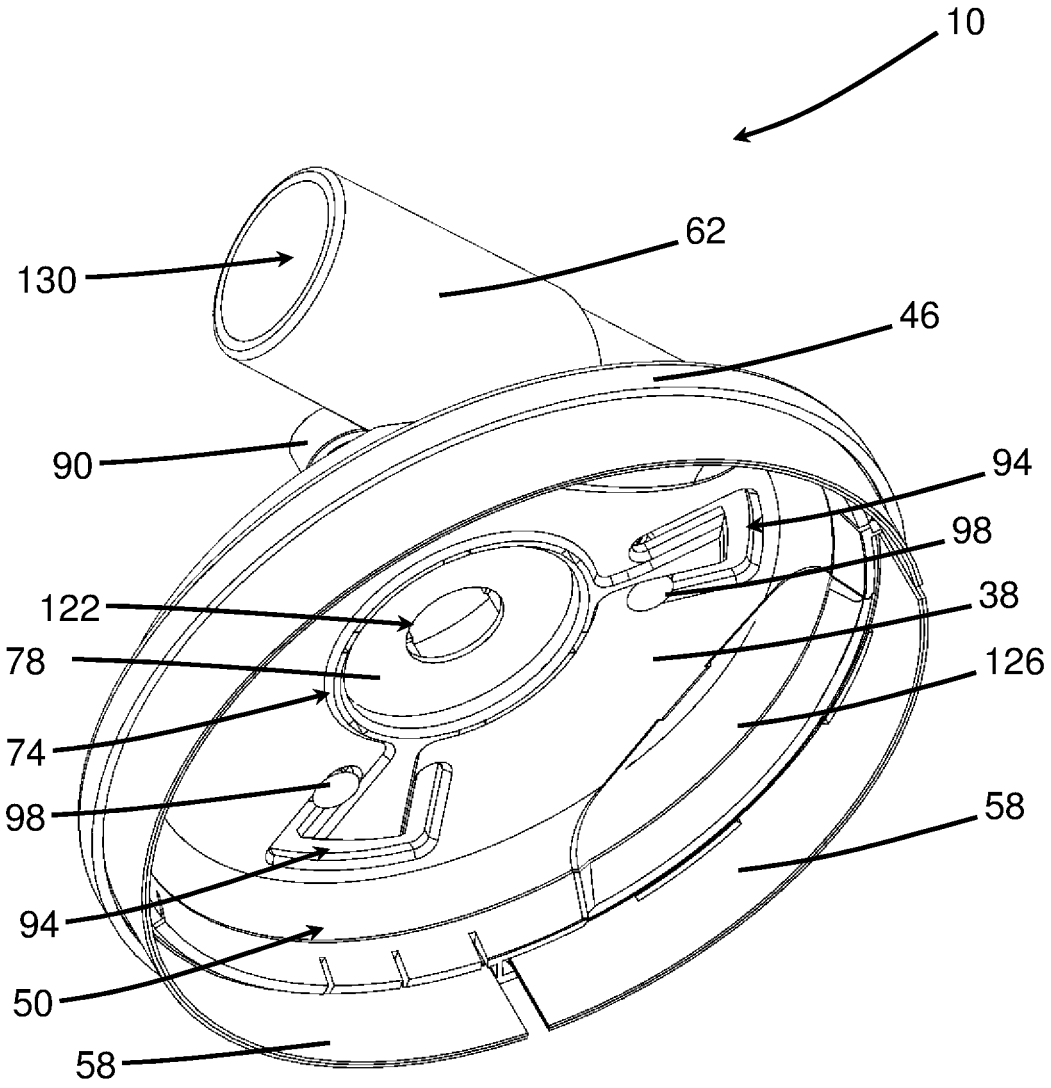
FIG. 5 is a drawing which shows a bottom perspective view of the dust collection shroud.

FIG. 5 shows a bottom perspective view of the shroud 10. The shape of the slots 94 can be seen. In the example shroud 10, the pins 98 have conical lower ends with a flat distal surface and engage a chamfered lower slot edge. It can also be seen how the hole 74 is larger than the grinder output shaft 30 and provides clearance while the hole 122 in the sealing gasket 78 is smaller and provides a close fit to the output shaft 30. The exhaust port 62 includes an air passage 130 which is open to the dust collection chamber 50 and allows a vacuum to collect air and dust from the dust collection chamber 50.

Figure 6:
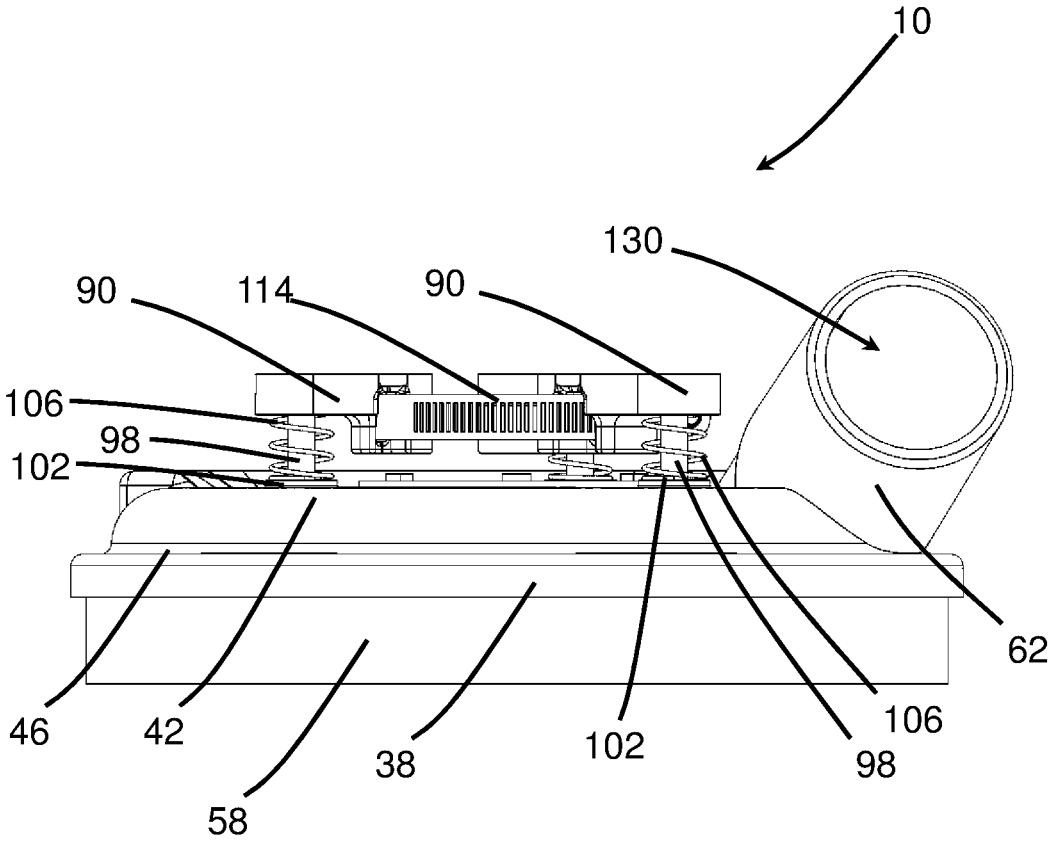
FIG. 6 is a drawing which shows a side view of the dust collection system.

FIG. 6 shows a side view of the dust collection shroud 10. This better illustrates the positioning of the pins 98, washers 102, springs 106, and mounting brackets 90 relative to the shroud body 38. The upper portion 42 of the shroud body 38 is flat around the slots 94 and the washers 102 are placed against the shroud body 38. The springs 106 are placed against the washers 102 and separate the mounting brackets 90 from the washers 102 and from the shroud body 38. The pins 98 extend through the shroud body 38, through the washers 102 and springs 106, and through the mounting brackets 90. The separation between the shroud body 38 and the mounting brackets 90 allows the shroud body to move towards the mounting brackets (and grinder 14) when the grinder 14 is in use. Typically, the springs 106 allow movement of the shroud body 38 towards the mounting brackets 90 a distance which is between about 0.2 inches and 0.5 inches. In the example shroud 10, the springs 106 are sufficiently strong to support the weight of the shroud body 38 so that the skirt 58 remains in contact if the grinder is used on a vertical or overhead work surface. The springs 106 are sufficiently light to not eliminate the operator's sensitivity in using the grinder 14.

The dust collection shroud 10 is advantageous as it allows for convenient attachment of a single dust collection shroud 10 and system to a variety of different angle grinders 14. The shroud is easily used and is convenient for an operator, promoting compliance in using the dust collection system. This promotes a clean work environment and reduces health hazards to the operator and others in the area. The shroud 10 is able to capture most of the dust created while grinding.

The above description of illustrated examples of the present invention, including what is described in the Abstract, are not intended to be exhaustive or to be limitation to the precise forms disclosed. While specific examples of the invention are described herein for illustrative purposes, various equivalent modifications are possible without departing from the broader scope of the present claims. Indeed, it is appreciated that specific example dimensions, materials, etc., are provided for explanation purposes and that other values may also be employed in other examples in accordance with the teachings of the present invention.

What is claimed is:

1. An angle grinder dust collection shroud comprising:

a shroud body having an upper portion and a peripheral sidewall extending downwardly from the upper portion to form a dust collection chamber;

an exhaust port attached to the shroud body, the exhaust port having an opening which is connected to the dust collection chamber;

an output shaft hole in the shroud body which is sized and positioned to receive an angle grinder output shaft therethrough;

a plurality of mounting brackets attached to the shroud body in spaced locations around the output shaft hole;

wherein each of the plurality of mounting brackets is movable towards and away from the output shaft hole to adjust a distance between the mounting brackets;

wherein a first mounting bracket of the plurality of mounting brackets is attached to the shroud body such that, while attached to the shroud body, it is movable towards the output shaft hole at a first angular location around the output shaft hole and such that, while still attached to the shroud body, it is movable towards the output shaft hole at a second angular location around the output shaft hole which is circumferentially spaced apart around the output shaft hole from the first angular location; and wherein the shroud body is attachable to an angle grinder via the plurality of mounting brackets so that an angle grinder output shaft extends into the dust collection chamber and so that a grinding attachment is attached to the angle grinder output shaft and disposed in the dust collection chamber.

2. The angle grinder dust collection shroud of claim 1, wherein the first mounting bracket is attached to the shroud body via a first slot formed in the shroud body; and wherein the first slot comprises a first slot section which allows the first mounting bracket to move towards and away from the output shaft hole at the first angular location and a second slot section which allows the first mounting bracket to move towards and away from the output shaft hole at the second angular location.

3. The angle grinder dust collection shroud of claim 2, wherein the first slot further comprises a third slot section which connects the first slot section to the second slot section, and wherein the third slot section allows the first mounting bracket to move around the output shaft hole between the first slot section and the second slot section.

4. The angle grinder dust collection shroud of claim 2, wherein a second mounting bracket of the plurality of mounting brackets is attached to the shroud body via a second slot formed in the shroud body; and wherein the second slot comprises a first slot section which allows the second mounting bracket to move towards and away from the output shaft hole at a first angular location and a second slot section which allows the second mounting bracket to move towards and away from the output shaft hole at a second angular location which is circumferentially spaced apart around the output shaft hole from the first angular location.

5. The angle grinder dust collection shroud of claim 4, wherein a third mounting bracket of the plurality of mounting brackets is attached to the shroud body via a third slot formed in the shroud body, and wherein the third slot comprises a first slot section which allows the third mounting bracket to move towards and away from the output shaft hole at a first circumferential location and wherein the third slot does not include a second slot section which allows the third mounting bracket to move towards and away from the output shaft hole at a second circumferential location different from the first circumferential location.

6. The angle grinder dust collection shroud of claim 2, wherein the first mounting bracket is attached to the shroud body via a pin which extends through the first slot.

7. The angle grinder dust collection shroud of claim 6, further comprising a spring disposed between the shroud body and the first mounting bracket, and wherein the spring biases the first mounting bracket away from the shroud body and allows the shroud body to move towards the first mounting bracket against the bias of the spring.

8. The angle grinder dust collection shroud of claim 1, further comprising a band clamp which extends around a portion of the plurality of mounting brackets to attach the plurality of mounting brackets to an angle grinder.

9. The angle grinder dust collection shroud of claim 1, further comprising a sealing gasket attached to the shroud body to cover a portion of the output shaft hole, and wherein the sealing gasket comprises an output shaft hole which is smaller than the shroud body output shaft hole.

10. The angle grinder dust collection shroud of claim 9, wherein the sealing gasket is a generally flat gasket attached to the upper portion of the shroud body.

11. The angle grinder dust collection shroud of claim 1, wherein the dust collection shroud is attached to an angle grinder such that the plurality of mounting brackets are attached to the angle grinder on an angle grinder surface surrounding an angle grinder output shaft and such that the angle grinder output shaft passes through the output shaft hole and extends into the dust collection chamber.

12. An angle grinder dust collection shroud comprising:

a shroud body having an upper portion and a peripheral sidewall extending downwardly from the upper portion to form a dust collection chamber;

an exhaust port attached to the shroud body, the exhaust port having an opening which is connected to the dust collection chamber;

an output shaft hole in the shroud body which is sized and positioned to receive an angle grinder output shaft therethrough;

a plurality of mounting brackets attached to the shroud body in spaced locations around the output shaft hole;

wherein each of the plurality of mounting brackets is movable towards and away from the output shaft hole to adjust a distance between the mounting brackets;

wherein a first mounting bracket of the plurality of mounting brackets is attached to the shroud body via a first slot formed in the shroud body; and wherein the first slot comprises a first slot section which allows the first mounting bracket, while attached to the shroud body, to move towards and away from the output shaft hole at a first angular location around the output shaft hole and a second slot section which allows the first mounting bracket, while still attached to the shroud body, to move towards and away from the output shaft hole at a second angular location around the output shaft hole which is spaced apart from the first angular location; and wherein the shroud body is attachable to an angle grinder via the plurality of mounting brackets so that an angle grinder output shaft extends into the dust collection chamber and so that a grinding attachment is attached to the angle grinder output shaft and disposed in the dust collection chamber.

13. The angle grinder dust collection shroud of claim 12, wherein the first slot further comprises a third slot section which connects the first slot section to the second slot section, and wherein the third slot section allows the first mounting bracket to move around the output shaft hole between the first slot section and the second slot section.

14. The angle grinder dust collection shroud of claim 12, wherein a second mounting bracket of the plurality of mounting brackets is attached to the shroud body via a second slot formed in the shroud body; and wherein the second slot comprises a first slot section which allows the second mounting bracket to move towards and away from the output shaft hole at a first angular location and a second slot section which allows the second mounting bracket to move towards and away from the output shaft hole at a second angular location which is spaced apart around the output shaft hole from the first angular location.

15. The angle grinder dust collection shroud of claim 12, wherein the first mounting bracket is attached to the shroud body via a pin which extends through the first slot.

16. The angle grinder dust collection shroud of claim 15, further comprising a spring disposed between the shroud body and the first mounting bracket, and wherein the spring biases the first mounting bracket away from the shroud body and allows the shroud body to move towards the first mounting bracket against the bias of the spring.

17. The angle grinder dust collection shroud of claim 12, further comprising a generally flat sealing gasket attached to the shroud body to cover a portion of the output shaft hole, and wherein the sealing gasket comprises an output shaft hole which is smaller than the shroud body output shaft hole.

18. An angle grinder dust collection shroud comprising:

a shroud body having an upper portion and a peripheral sidewall extending downwardly from the upper portion to form a dust collection chamber;

an exhaust port attached to the shroud body, the exhaust port having an opening which is connected to the dust collection chamber;

an output shaft hole in the shroud body which is sized and positioned to receive an angle grinder output shaft therethrough;

a plurality of mounting brackets attached to the shroud body in spaced locations around the output shaft hole;

wherein each of the plurality of mounting brackets is movable towards and away from the output shaft hole to adjust a distance between the mounting brackets;

wherein a first mounting bracket of the plurality of mounting brackets is attached to the shroud body such that the first mounting bracket of the plurality of mounting brackets, while attached to the shroud body, is movable between a first position and a second position towards and away from the output shaft hole and wherein the first mounting bracket, while still attached to the shroud body, is movable between the first position and a third position around the output shaft hole; and wherein the shroud body is attachable to an angle grinder via the plurality of mounting brackets so that an angle grinder output shaft extends into the dust collection chamber through the output shaft hole.

19. The angle grinder dust collection shroud of claim 18, wherein the first mounting bracket is movable between the third position and a fourth position towards and awayfrom the output shaft hole.

20. The angle grinder dust collection shroud of claim 19, wherein the first mounting bracket is attached to the shroud body via a first slot and wherein the first slot comprises a first slot section which allows the first mounting bracket to move between the first position and the second position and a second slot section which allows the first mounting bracket to move between the first position and the third position.

* * * * *